US005598199A

United States Patent [19]

Mielke

[11] Patent Number: 5,598,199

[45] Date of Patent: Jan. 28, 1997

[54] PRINTER

[75] Inventor: Ulf Mielke, Göteborg, Sweden

[73] Assignee: Jetline AB, Molndal, Sweden

[21] Appl. No.: 244,874

[22] PCT Filed: Dec. 16, 1992

[86] PCT No.: PCT/SE92/00870

§ 371 Date: Oct. 24, 1994

§ 102(e) Date: Oct. 24, 1994

[87] PCT Pub. No.: WO93/11944

PCT Pub. Date: Jun. 24, 1993

[51] Int. Cl.[6] ..... B41J 2/175

[52] U.S. Cl. ..... 347/88; 347/92

[58] Field of Search ..... 347/88, 92, 93, 347/99

[56] References Cited

U.S. PATENT DOCUMENTS

| | | | |
|---|---|---|---|
| 4,593,292 | 6/1986 | Lewis . | |
| 4,682,187 | 7/1987 | Martner | 347/88 |
| 4,723,131 | 2/1988 | Droit | 347/54 |
| 4,870,430 | 9/1989 | Daggett et al. . | |
| 4,961,082 | 10/1990 | Hoisington et al. | 347/88 |
| 4,998,120 | 3/1991 | Koto et al. | 347/88 |

FOREIGN PATENT DOCUMENTS 0178888 4/1986 European Pat. Off. .

OTHER PUBLICATIONS

Patent Abtracts of Japan, vol. 8, No. 197, M–324, abstract of JP,A,59–87162 (Hitachi Seisakusho K.K.), 19 May 1984.

*Primary Examiner*—John E. Barlow, Jr.
*Attorney, Agent, or Firm*—Dvorak and Traub

[57] ABSTRACT

A printer for application of droplets of hot melt ink on a substrate in order to generate characters or symbols thereon includes a compact and space saving housing containing a reservoir for supply of the hot melt ink in a solid state, a feeder for reception of the hot melt ink in the solid state form the reservoir, and a printhead having one or several discharge nozzles. Between the feeder and the printhead a chamber is provided in the housing and the feeder is adapted to feed the hot melt ink by means of positive displacement to the chamber while the ink is melted by a heater arranged in the housing. The printhead receives the hot melt ink in a melted state from the chamber and discharges it in the form of droplets from the nozzles for application on the substrate. The reservoir includes perforations to allow carrier gases to escape.

17 Claims, 1 Drawing Sheet

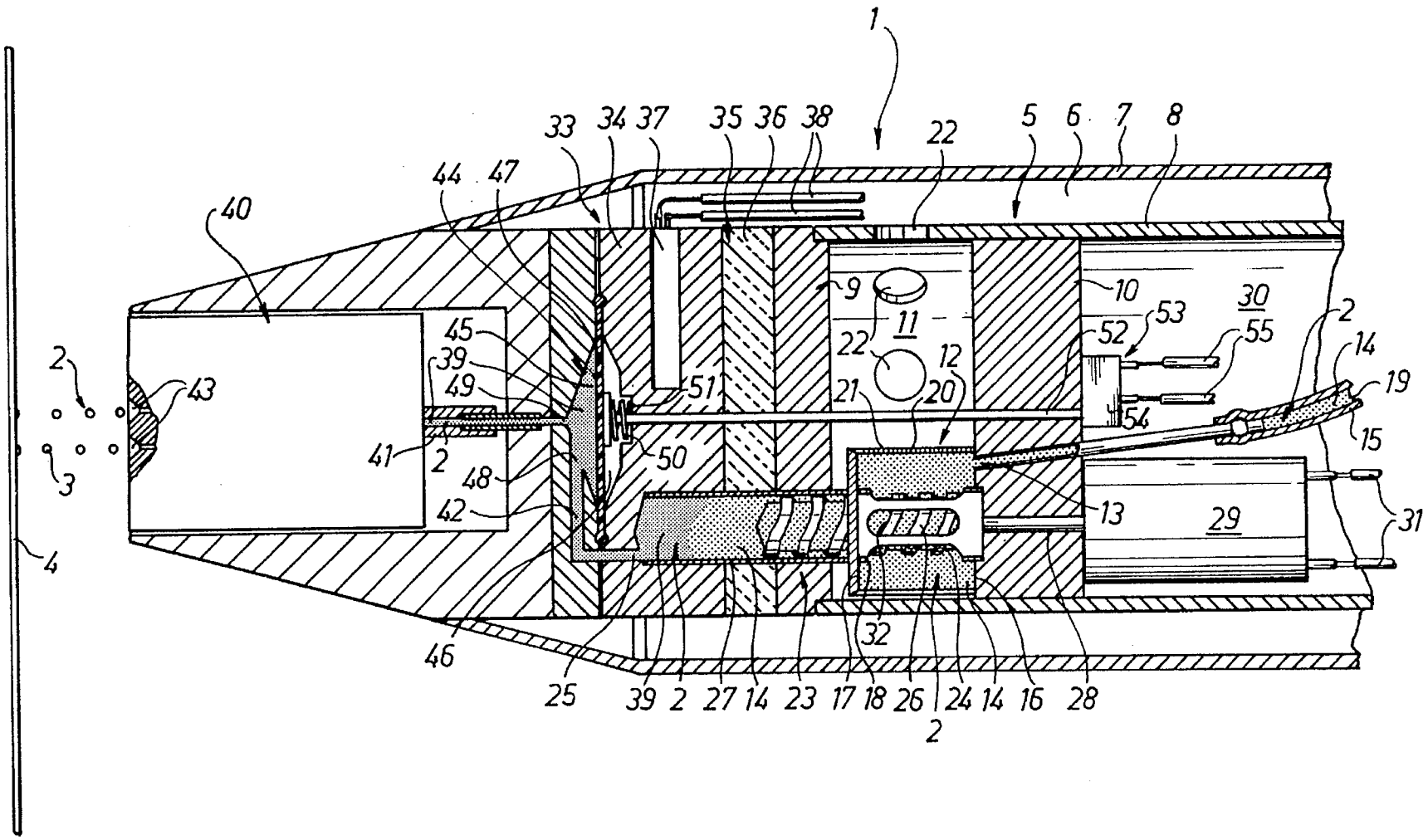
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54
55

PRINTER

The subject invention concerns a printer designed to apply droplets of hot melt ink onto a substrate in order to generate characters or symbols thereon.

In one prior-art device incorporating a printer for the purposes mentioned, an external reservoir is immersed in a hot water bath or the like and is connected via a comparatively long hose or tube to the printer proper, the latter having a print-head including one or several discharge nozzles.

Hot melt ink in solid form is supplied to the reservoir in which the hot melt ink melts when affected by the hot water bath and from whence the molten hot melt ink is transferred via the hose or the pipe to the printer itself to be applied on the substrate.

In order to prevent the molten hot melt ink from returning to the solid phase while being advanced inside the hose or the pipe or inside the printer, the hose or pipe as well as the printer must be kept heated, which may be effected by means of infra-red radiation or other heating arrangements.

A serious drawback found in this prior-art device is that it is composed of several spaced apart, separate components which in addition must be maintained in a heated condition along the entire and comparatively long path of travel of the molten hot melt ink from the reservoir to the print-head. The heating causes problem also because the heat energy input must be comparatively high in view of the heat losses to the environment.

The purpose of the subject invention is to avoid the disadvantages and the problems inherent in the prior-art device and to provide a printer which is complete in itself while at the same time it is compact and efficient.

The purpose is achieved in a manner which is as simple as it is ingenious in that the printer has a housing in which are provided a reservoir having an inlet for supply of the hot melt ink in solid state and an outlet, a feeder adjacent the reservoir outlet, said feeder having an inlet for reception of the hot melt ink in solid state from the receiver and an outlet, a heater, and a print-head having an inlet which is connected to the feeder outlet and at least one discharge nozzle, said feeder supplying the hot melt ink, preferably by positive displacement, to the print-head while the ink is being melted with the aid of the heater, said print-head receiving said molten hot melt ink from the feeder and discharging it in the shape of droplets from the discharge nozzle for application of said droplets on the substrate.

The invention will be described in closer detail in the following with reference to the accompanying drawing, which in a longitudinal sectional view schematically. illustrates a presently particularly preferred embodiment of the printer, the rear end of which, appearing to the right-hand side of the drawing, being cut away.

The printer designed generally on the drawing figure by reference numeral 1, is designed for application of molten hot melt ink 2 in the form of droplets 3 onto a substrate 4, such as e.g. paper, cardboard or the like which may be used to form packages of various kinds, primarily for foodstuff, in order to generate symbols or characters on said substrate 4. When the droplets 3 hit the substrate 4 they solidify as they are cooled on impact.

When the substrate 4 has an external protective plastic film, which often is the case in connection with foodstuff packages, the droplets are etched to the film as the latter softens or melts when hit by the droplets. The characters or symbols thus produced become forgery-proof in that if one tries to remove them from the substrate, they leave behind an identifiable impression in the subjacent plastic film or even on the packaging material itself.

In accordance with the embodiment illustrated, the printer 1 comprises a housing 5 of an essentially circular cylindrical shape, and a cover 7 positioned at a distance 6 from and around the housing.

The housing 5 has a tubular jacket 8 of a suitable material, such as aluminium, and at its rear (right-hand side in the drawing figure) the tubular jacket 8 is connected to an end wall, not shown, and at its front to a disc-shaped partition wall 9, for instance of aluminium or other suitable material.

Between the end wall and the partition wall 9 a likewise disc-shaped partition wall 10, also of aluminium, is provided. This wall, too, thus is positioned within the tubular jacket 8.

In the space 11 between the partition wall 9 and the partition wall 10 a reservoir 12 is located, said reservoir having an inlet 13 for supply of the hot melt ink 2 in solid state 14 from a storage, not shown, via a tube 15 or the like. The inlet 13 is provided in the partition wall 10, said wall also forming one, 16, of the two end walls 16 and 17 of the reservoir 12. In the opposite end wall 17 of the reservoir 12 an outlet 18 to be described in the following, is provided.

In accordance with the illustrated embodiment, the hot melt ink 2 in solid state 14 is intended to be supplied to the reservoir 12 from the storage in the shape of granules together with a carrier gas 19, such as pressurized air. For this purpose, the reservoir 12 is equipped with a jacket 20 in which perforations 21 are formed to allow discharge from the reservoir of the carrier gas 19 supplied thereto. Preferably, the perforations are in the shape of a gas-pervious net which thus forms the jacket 20 of the reservoir 12.

The granular material used presently has an average diameter of approximately 0.3–0.5 mm. and the gas-pervious net 20 consequently has a mesh size smaller than the average diameter of the granules.

The carrier gas 19 emitted from the reservoir may flow out of the housing 5 to the environment via apertures 22 formed in the tubular jacket 8.

Instead of having a positive pressure as suggested above, the carrier gas 19 could have a negative pressure, that is, be sucked into the reservoir 12 together with the granules. In this case a suction means, not shown, may be provided in the space 11, for instance an ejector which creates a negative pressure inside the reservoir 12.

Another possibilitiy is to configure the reservoir 12 as a completely closed and pressure-tight container which is subjected to a positive pressure and may be equipped with a sluice valve or an equivalent means, allowing the granular material to be supplied in batches or continously. In this manner the positive pressure forces the granules to advance in the direction towards the outlet 18 of the reservoir 12.

Another possible solution is to supply the hot melt ink 2 in solid state 14 to the reservoir 12 in the shape of rods or the like instead of in the shape of granules.

Inside the housing 5, in the area of the outlet 18 of the reservoir 12, a feeder, generally designated by numeral 23, is located, said feeder having an inlet 24 for reception of the hot melt ink 2 in solid state 14 from the reservoir, and an outlet 25.

More precisely, the feeder in accordance with the illustrated embodiment is configured as a screw worm 26 which is rotationally mounted in an enclosing housing 27.

Via a drive shaft 26 extending through the partition wall 10, the screw worm 26 is rotated by an electric motor 29, the latter being positioned in the space 30 between the partition wall 10 and the rear end wall, not shown, of the housing 5, and being electrically connected to a source of electricity, not shown, by means of electric wires 31.

The housing 27 of the feeder 23 is formed with one or several apertures 32 positioned inside the reservoir and forming the feeder inlet 24 for reception of the hot melt ink 2 in solid state 14 from the reservoir 12 and for transport of the ink by means of the screw worm 26 along the housing 27 in the direction towards the feeder outlet 25.

It is quite possible to design the feeder 23 differently from the configuration described in the afore-going. For instance, instead of the screw worm 26 and its housing 27 a piston, arranged for reciprocating movement inside a cylinder, could be used. Alternatively, the feeder could be designed as one or several elongate channels through which the hot melt ink 2 is conveyed under the influence of the positive pressure inside the reservoir 12 when the latter is configured in accordance with the pressurized embodiment described previously.

Downstream of the reservoir 12, inside the housing 5, there is provided a heater, generally designated by 33. In accordance with the embodiment illustrated the heater is formed by a comparatively thick disc-shaped heating block 34 of a material possessing good heat conducting properties.

In order to insulate the reservoir 12 as well as the other components in the housing upstream of the heater 33 from the heat generated by the latter, heat insulation 35 in the form of a disc-shaped plate 36 is provided. The plate may be made from a heat-insulating plastic, such as bakelite, and it is mounted inside the housing 5 intermediate the reservoir 12 and the heater 33.

An electric heating cartridge 37 is positioned in a recess in the heating block 34 in order to heat the latter, said heating cartridge being electrically connected to the power source, not shown, by means of electric wires 38.

As appears from the drawing, the heating block 34 encloses and heats the feeder 23 downstream of the heat insulation 35, with the result that the hot melt ink 2 changes from its solid state 14 to a liquid or molten state 39 before reaching the outlet 25 of the feeder 23.

The temperature of the hot melt ink 2 in liquid state 39 varies as a function of the composition of the hot melt ink but generally speaking the melting temperature ranges from a minimum of about 70° C. to a maximum of about 180° C. for hot melt inks available at present. In practice, the temperatures used range from about 120° to about 150° C.

The housing 5 also includes a print-head, generally designated by reference 40, which forms the front end (left-hand end on the drawing figure) of the printer 1. The print-head 40 has a rear inlet 41 which via a channel 42 is connected to the outlet 25 of the feeder 23, and at least one front discharge nozzle 43 from which droplets 3 of the molten hot melt ink 2 are discharged to be applied on the substrate 4.

Since the print-head 40 does not form part of the subject invention and is of a more or less conventional construction it will not be described in any detail herein.

Inside the channel 42, intermediate the outlet 25 of the feeder 23 and the inlet of the print-head 40 a chamber, generally designated by reference 44, is provided in accordance with the embodiment illustrated. The chamber is divided into one pressure part 45 and one actuating part 46. These parts 45, 46 are separated by a diaphragm 47 of an resilient and impervious material, such a rubber of a quality that withstands the high temperature of the melted hot melt ink 2.

The pressure part 45 has an inlet 48 and an outlet 49 and the inlet 48 is connected to the part of the channel 42 that extends between the pressure part and the outlet 25 of the feeder 23, whereas the outlet 49 is connected to the channel part extending between the pressure part and the inlet 41 of the print-head 40.

The actuating part 46 of the chamber 44 encloses an actuating means 50 in the shape of a compression spring which is held between the diaphragm 47 and the opposite side or bottom 51 of the actuating part 45 to act on the diaphragm with an adjustable force and accordingly to effect variable pressurization of the melted hot melt ink 2 in the pressure part 45.

An operating element 52 in the form of a rod extending through the heater 33, the heat insulation 35, and the partition walls 9 and 10 connects the compression spring 50 to a regulating means 53 which is housed in the space 30. The regulating means 53 consists of a switch 54 which via electric wires 55 is electrically connected to the electric motor 29 for operation of the screw worm 26 inside the feeder 23.

When the electric motor 29 is energized and rotates the screw worm 26, the volume of the pressure part 45 of the chamber 44 increases as the hot melt ink 2 in melted state 39 is supplied thereto. The diaphragm 47 consequently will bulge increasingly into the actuating part 46 against the action of the spring 50. At the same time the diaphragm will push the rod 52 to the right as seen in the drawing figure, to a position wherein the switch is affected and interrupts the supply of electricity to the electric motor 29 with consequential stop of the screw worm 26.

When the print-head 40 in the conventional manner receives a signal to discharge droplets 3 of melted hot melt ink 2 from the discharge nozzle 43 in order to generate symbols or charactaers on the substrate 4 the volume of the pressure part 45 of the chamber 44 gradually is reduced as the hot melt ink 2 in melted state 39 is being consumed. Under the influence of the spring 50 the diaphragm therefore will bulge increasingly into the pressure part 45, bringing along the rod 52 in its movement, to the left as seen in the drawing figure, to another position, wherein the switch is again actuated and re-establishes the electricity supply to the electric motor 29, whereby the screw worm 26 again starts feeding the pressure part with melted hot melt ink.

This procedure is repeated and in response to the requirement of the print-head to be supplied with hot melt ink 2 in melted state 39 from the pressure part 45 the screw worm 26 may operate from an almost continuous mode to one involving rather brief operational steps.

In cases when the feeder 23, as mentioned previously, is configured otherwise than as a screw worm 26, for example in accordance with the embodiment comprising channels and a pressurized recevoir 12, the chamber 44 as well as the actuating and operational components associated therewith for controlling the operation of the electric motor 29, may be superfluous and therefore could be eliminated.

I claim:

1. A printer designed to apply droplets of hot melt ink onto a substrate in order to generate characters or symbols thereon, characterized by a housing, in which are provided a reservoir having an inlet for supply of the hot melt ink in solid state and an outlet, the hot melt ink in solid state is arranged to be supplied to the reservoir in the form of granules together with a carrier gas, and in that said reservoir is provided with perforations to allow escape of said carrier gas supplied thereto, a feeder adjacent the reservoir outlet, said feeder having an inlet for reception of the hot melt ink in solid state from the receiver and an outlet, a heater, and a print-head formed with an inlet which is connected to the feeder outlet and with at least one discharge nozzle, said feeder supplying the hot melt ink to the print-head while the ink is being melted with the aid of the heater, said print-head receiving said molten hot melt ink from the feeder and discharging said hot melt ink in the form of droplets from the discharge nozzle for application of said droplets on the substrate.

2. The printer as claimed in claim 1, wherein the feeder is configured as a worm screw which is driven by a motor and which is rotatably mounted inside a housing, said housing being formed with at least one aperture positioned in the reservoir and forming the feeder inlet opening to allow said worm screw to receive hot melt ink in solid state form from the reservoir and to transport said ink along the reservoir in the direction towards the feeder outlet.

3. The printer as claimed in claim 1, wherein the heater is a heating block enclosing and heating the feeder downstream of the heat insulating means and melting the hot melt ink therein before the ink reaches the feeder outlet.

4. A printer as claimed in claim 1, characterized in that the perforations in the reservoir (12) are formed by a net (21) forming the jacket (20) of the reservoir, and in that the granules have an average diameter size ranging from about 0.3 to 0.5 mm, the mesh size of said net being smaller than said average diameter.

5. A printer as claimed in claim 4, characterized in that the feeder (23) is configured as a screw worm (26) which is driven by a motor (29) and which is rotatably mounted inside a housing (27), said housing being formed with at least one aperture (32), said aperture positioned in the reservoir (12) and forming the feeder inlet opening (24) to allow said screw worm to receive hot melt ink (2) in solid state (14) from the reservoir and to transport said ink along the reservoir in the direction towards the feeder outlet (25).

6. A printer as claimed in claim 5, characterized in that the heater (33) is a heating block (34) enclosing and heating the feeder (23) downstream of the heat insulating means (35) and melting the hot melt ink (2) therein before the ink reaches the feeder outlet (25).

7. A printer as claimed in claim 6, characterized in that an electric heating cartridge (37) is arranged inside the heating block (34) to heat the latter.

8. A printer as claimed in claim 7, characterized in that the housing (5) also encloses a chamber (44) positioned intermediate the feeder (23) and the print-head (40) and having an inlet (48) which communicates with the feeder outlet (25) and an outlet (49) which communicates with the print-head inlet (41).

9. A printer as claimed in claim 8, characterized in that the chamber (44) is divided into one pressure part (45) and one acutating part (46), said parts being separated from one another by a diaphragm (47), and in that the inlet and the outlet (48 and 49, respectively) of the chamber respectively debouches into and departs from the pressure part, and in that the actuating part houses an actuating means (50) adapted to adjustably actuate the diaphragm and consequently to effect variable pressurization of the hot melt ink (2) inside the pressure part.

10. A printer as claimed in claim 9, characterized in that the actuating means (50) is arranged in yieldable abutment against the diaphragm (47) and is connected to a regulator means (53) via an operating means (52), said regulating means (53) being positioned inside the housing (5) upstream of the heat insulating means (35) and being connected to the motor (29) driving the screw worm (26), in order to start and stop the motor in response to the pressure inside the pressure part (45).

11. A printer as claimed in claim 4, characterized in that the heater (33) is a heating block (34) enclosing and heating the feeder (23) downstream of the heat insulating means (35) and melting the hot melt ink (2) therein before the ink reaches the feeder outlet (25).

12. A printer as claimed in claim 5, characterized in that the heater (33) is a heating block (34) enclosing and heating the feeder (23) downstream of the heat insulating means (35) and melting the hot melt ink (2) therein before the ink reaches the feeder outlet (25).

13. The printer as claimed in claim 1, wherein the housing also encloses a chamber positioned intermediate the feeder and the print-head and having an inlet which communicates with the feeder outlet and an outlet which communicates with the print-head inlet.

14. A printer designed to apply droplets of hot melt ink onto a substrate in order to generate characters or symbols thereon, characterized by a housing, in which are provided a reservoir having an inlet for supply of the hot melt ink in solid state and an outlet, the hot melt ink in solid state is arranged to be supplied to the reservoir in the form of granules together with a carrier gas, and in that said reservoir is provided with perforations to allow escape of said carrier gas supplied thereto, a feeder adjacent the reservoir outlet, said feeder having an inlet for reception of the hot melt ink in solid state from the receiver and an outlet, a heater, and a print-head formed with an inlet which is connected to the feeder outlet and with at least one discharge nozzle, and a heat-insulating means arranged inside the housing, between the reservoir and the heater, in order to insulate the reservoir from the heat from the heater, said feeder supplying the hot melt ink to the print-head while the ink is being melted with the aid of the heater, said print-head receiving said molten hot melt ink from the feeder and discharging said hot melt ink in the form of droplets from the discharge nozzle for application of said droplets on the substrate.

15. A printer as claimed in claim 14, characterized in the feeder (23) is configured as a screw worm (26) which is driven by a motor (29) and which is rotatably mounted inside a housing (27), said housing being formed with at least one aperture (32), said aperture positioned in the reservoir (12) and forming the feeder inlet opening (24) to allow said screw worm to receive hot melt ink (2) in solid state (14) from the reservoir and to transport said ink along the reservoir in the direction towards the feeder outlet (25).

16. A printer as claimed in claim 14, characterized in that the heater (33) is a heating block (34) enclosing and heating the feeder (23) downstream of the heat insulating means (35) and melting the hot melt ink (2) therein before the ink reaches the feeder outlet (25).

17. A printer as claimed in claim 14, characterized in that the housing (5) also encloses a chamber (44) positioned intermediate the feeder (23) and the print-head (40) and having an inlet (48) which communicates with the feeder outlet (25) and an outlet (49) which communicates with the print-head inlet (41).

* * * * *

UNITED STATES PATENT AND TRADEMARK OFFICE

CERTIFICATE OF CORRECTION

PATENT NO. : 5,598,199

DATED : January 28, 1997

INVENTOR(S) : MIELKE, Ulf

It is certified that error appears in the above-indentified patent and that said Letters Patent is hereby corrected as shown below:

TITLE PAGE

Please add the following priority:

--Swedish Application No. 9103764-8

Dated: December 19, 1991--.

Signed and Sealed this

Thirteenth Day of May, 1997

Bruce Lehman

*Attest:*

BRUCE LEHMAN

*Attesting Officer*

*Commissioner of Patents and Trademarks*